United States Patent [19]

Ikeda

[11] Patent Number: 4,801,966

[45] Date of Patent: Jan. 31, 1989

[54] IMAGE FORMING APPARATUS WITH MOVABLE DEVELOPING DEVICE

[75] Inventor: Masamichi Ikeda, Yokohama, Japan

[73] Assignee: Canon Kabushiki Kaisha, Tokyo, Japan

[21] Appl. No.: 844,718

[22] Filed: Mar. 27, 1986

[30] Foreign Application Priority Data

Apr. 6, 1985 [JP] Japan ..... 60-73123
Dec. 11, 1985 [JP] Japan ..... 60-278485

[51] Int. Cl.[4] ..... G03G 15/01

[52] U.S. Cl. ..... 355/4; 355/3 DD; 355/14 D

[58] Field of Search ..... 355/4, 14 D, 14 R, 3 DD

[56] References Cited

U.S. PATENT DOCUMENTS 3,531,195 9/1970 Tanaka et al. ..... 355/4
3,854,449 12/1974 Davidson ..... 355/3 DD X
3,970,042 7/1976 Rees ..... 355/4 X
4,339,196 7/1982 Beck et al. ..... 355/14 D X
4,429,986 2/1984 Abe et al. ..... 355/8

FOREIGN PATENT DOCUMENTS 2031500 6/1970 Fed. Rep. of Germany .
55-111973 8/1980 Japan ..... 355/3 DD
1320509 6/1973 United Kingdom .

*Primary Examiner*—A. C. Prescott
*Assistant Examiner*—Jane Lau
*Attorney, Agent, or Firm*—Fitzpatrick, Cella, Harper & Scinto

[57] ABSTRACT

An image forming apparatus wherein a latent image is formed on an image bearing member, corresponding to the image information to be recorded by the charging and exposure steps effected to the image bearing member. The latent image is developed, and the developed image is transferred onto a transfer material. The developing device is movable between its operative position where it is capable of developing the latent image on the image bearing member and its inoperative position where the developing device is retracted from the operative position. A control device is provided to effect the movement of the developing device between the operative position and the inoperative position at other than the image exposure step or not during the transfer step.

10 Claims, 4 Drawing Sheets

IMAGE FORMING APPARATUS WITH MOVABLE DEVELOPING DEVICE

FIELD OF THE INVENTION AND RELATED ART

The present invention relates to an image forming apparatus, more particularly, to an image forming apparatus comprising an image bearing member such as an electrophotographic photosensitive member, around which one or more developing devices are disposed, which device is movable between an operative position wherein the developing device is close to the image bearing member to develop a latent image formed on the image bearing member and an inoperative position wherein the developing device is away from the image bearing member. The present invention is applicable to a monochromatic image forming apparatus, but also to a so-called multi-color image forming apparatus wherein a combined image is formed in two or more different colors, and also to a so-called full color image forming apparatus. The image forming apparatus referred to in this specification covers an electrophotographic copying apparatus, a color printing apparatus such as a color printer constituting an output of a computer or a facsimile machine, and other various image forming machines.

Recently, the demand for color copying or printing has rapidly increased in ordinary office work as well as in specialty fields. Therefore, it is desired that a color image forming apparatus be easy to operate and provide a high quality image. It is sometimes required that a multi-color original consisting of two or more monochromatic images or a full color original is reproduced or printed in a desired color. Therefore, not only in a multi-color image forming apparatus, but also in a full color image forming apparatus, it is required that the reproducing and copying operations can be efficiently performed in selected two or more colors.

To meet those demands, it is considered that the color image forming apparatus is provided with a plurality of developing devices containing different color developers and disposed around the image bearing member such as an electrophotographic photosensitive member, wherein each of the developing devices is movable between its operative position wherein the developing device is close to the image bearing member to develop a latent image formed on the image bearing member and an inoperative position wherein it is away from the image bearing member. When the selected developing device among the plural developing devices is moved to its operative position for the purpose of developing the latent image on the image bearing member with the coloring developer, it is sometimes preferable that the gap formed between the image bearing member and a developer carrying member, for example, a developing sleeve, of the developing device is kept substantially constant so as to provide substantially constant developing conditions, as shown in Japanese Patent Application Publication No. 15444/1976. There are various methods of keeping the constant gap. It is usual that the developing sleeve has a spacer roller at each of the opposite longitudinal ends thereof. The rollers are coaxial with the developing sleeve so that a constant gap is maintained when the roller abuts the image bearing member. On the other hand, the non-selected developing device or devices are retracted away from the image bearing member so as to prevent an undesirable mixture of colors.

It has been found, however, that the structure of maintaining a constant gap between the developing sleeve and the image bearing member by abutting the spacer rollers to the image bearing member, can involve a problem that the spacer rollers give an impact to the image bearing member when the developing device moves and abuts it. If, therefore, the developing device is shifted to its operative position immediately before the start of the developing operation, and/or if the developing device is shifted back to its inoperative position at the end of the developing operation, the shock resulting from the movement influences the uniform rotation of the image bearing member, which deteriorates the quality of the resultant image.

There is another method to maintain the constant gap between the image bearing member and the developing sleeve, wherein no such rollers are used, instead, the constant gap is maintained by manufacturing the supporting members for the image bearing member and the developing sleeve with increased accuracy or by supporting member. improving the shape of the supporting member. However, in this type of structure, the movement of the developing device can give a shock or impact resulting in formation of a blurred image.

Some developing devices do not require the formation of a gap between the image bearing member and the developing sleeve, in which, however, some shock can be given to the image bearing member when the developing device shifts.

SUMMARY OF THE INVENTION

Accordingly, it is a principal object of the present invention to provide an image forming apparatus which can provide non-blurred images of good quality.

It is another object of the present invention to provide an image forming apparatus wherein the movement of the developing device toward and away from its operative position does not adversely affect the formation of the image by considering the timing of its movement.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

The image forming apparatus according to the present invention is preferably embodied in an apparatus performing a process which comprises the steps of forming an electrostatic latent image by image exposure, developing the latent image into a visualized image and transferring the developed or visualized image onto a transfer material. In the following description, a two color electrophotographic copying apparatus is taken which can provide a black image and a red image. As for the electrostatic latent image formation, various processes can be used, such as a so-called NP process comprising a primary charging step, a simultaneous secondary charging and color separated image exposure step and a whole surface exposure step, a so-called Carlson process comprising a primary charging and color separated image exposure step and other processes. In this Specification the Carlson process is taken as an example in the following explanation for the sake of simplicity.

Figure 1:
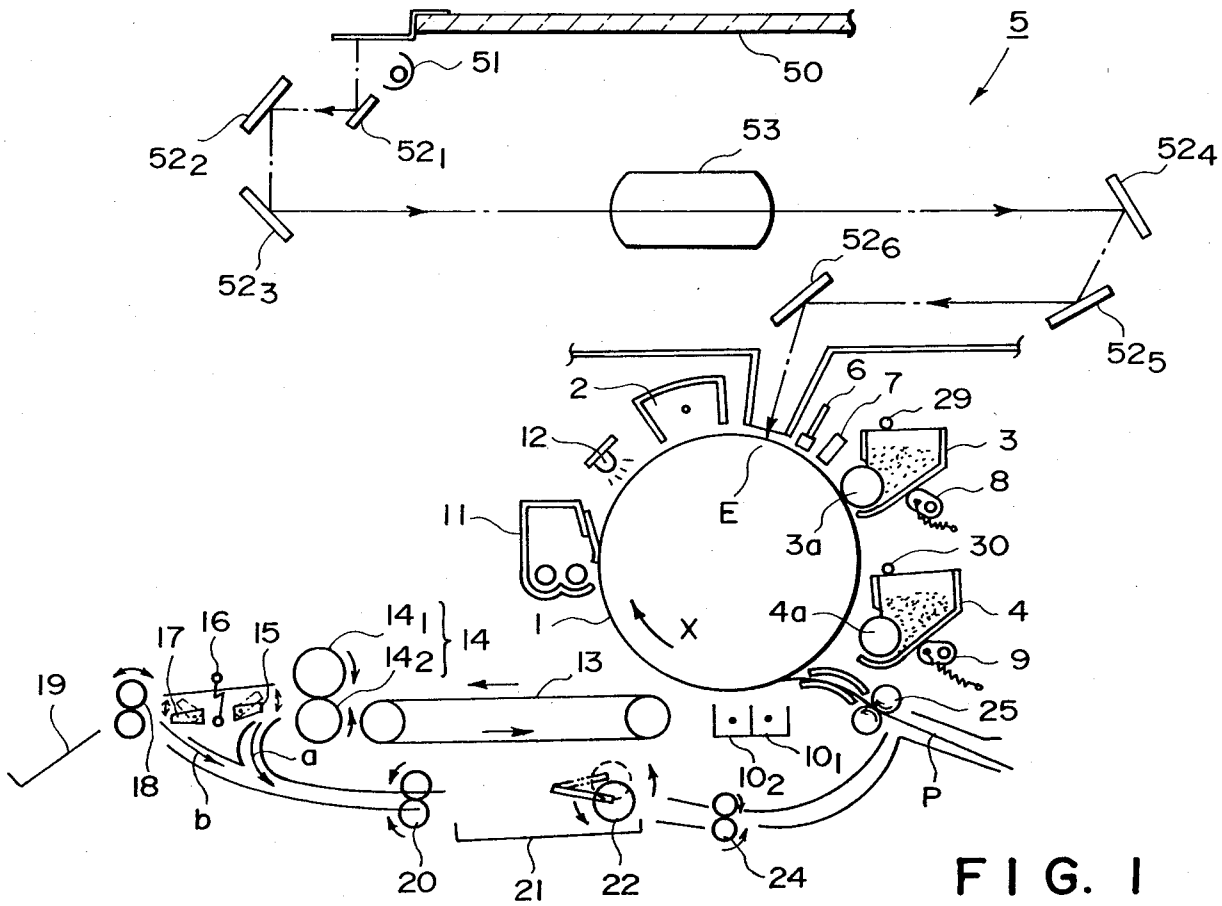
FIG. 1 is a somewhat schematic sectional view of a two color copying apparatus having two developing devices according to an embodiment of the present invention.

Referring now to FIG. 1, a two color electrophotographic copying apparatus is shown in cross-section. The apparatus includes an image bearing member in the neighborhood of the center of the apparatus. In this embodiment, the image bearing member is a photosensitive drum 1 having a surface layer of electrophotographic photosensitive material. The photosensitive drum 1 is rotatably and dismountably supported on a shaft (not shown) and is driven by an unshown driving motor. In this embodiment, the photosensitive drum 1 rotates in operation in the direction indicated by an arrow X, that is, in the clockwise direction as seen in FIG. 1.

Around the photosensitive drum 1, there are arranged a primary charger 2 substantially above the photosensitive drum 1, developing devices 3 and 4 substantially at the right side of the photosensitive drum 1 as seen in FIG. 1, a transfer charger $\mathbf{10}_1$ and a separating discharger $\mathbf{10}_2$ substantially at the bottom thereof and a cleaning device 11 substantially at the left side of the photosensitive drum 1 as seen in FIG. 1.

Adjacent the top portion of the apparatus, there is an optical system 5. An original to be copied supported on an original carriage or table 50 is illuminated by an original illuminating lamp or exposure lamp 51. The light image produced by the illumination as light information is projected to the photosensitive drum 1 at an exposure position E disposed between the charger 2 and the developing device 3 by way of a first mirror $\mathbf{52}_1$, a second mirror $\mathbf{52}_2$, a third mirror $\mathbf{52}_3$, a zoom lens 53, a fourth mirror $\mathbf{52}_4$, a fifth mirror $\mathbf{52}_5$ and a sixth mirror $\mathbf{52}_6$. In this embodiment, the copying magnification can be changed by operating the zoom lens 53. In this embodiment, between the exposure position E and the developing device 3, there are provided a charge removing means (LED array or the like) 6 for removing unnecessary charge outside the image forming area on the photosensitive drum 1 and a potential sensor 7 for determining the surface potential on the photosensitive drum 1. Between the cleaning device 11 and the primary charger 2, there is a pre-exposure light source 12 for removing residual electric charge from the photosensitive drum 1.

In this embodiment, the optical system 5 is of such a type wherein the original supported on a stationary original table is scanned by a moving optical system, but it may be of the type wherein the optical system is fixed and the original supporting table is movable. Further, the present invention is applicable to the case where image information produced by external equipment is converted to a light signal such as a modulated laser beam, and the light signal corresponding to the image information is thrown to the photosensitive drum 1.

The color copying apparatus in this embodiment is capable of providing black and red images, so that two developing devices 3 and 4 are contained in the apparatus. However, the present invention is not limited to this case, and is usable with an apparatus having one developing device or three or more developing devices.

The image forming operation on the photosensitive drum 1 will be described. Upon start of the image forming operation, the photosensitive drum 1 starts rotating in the direction of the arrow X, and is uniformly charged by the charger 2 (charging step). The photosensitive drum 1 thus charged further rotates and is exposed through a slit to image light corresponding to the original image to be copied at the exposure position E by the above-described optical system 5 (exposure step), whereby an electrostatic latent image is formed on the photosensitive drum 1 in accordance with the original image. At this time, unnecessary charge outside the imaging area is erased by the charge removing device 6. On the other hand, the potential sensor 7 detects the surface potential of the photosensitive drum 1. In accordance with the result of detection, the potential is controlled. The latent image formed on the photosensitive drum is brought to the developing station where the developing devices 3 and 4 are disposed. The electrostatic latent image is developed by a selected one of the developing devices 3 and 4 into a visualized toner image (developing step).

The toner image thus produced on the photosensitive drum 1 is then brought to the transfer station where the transfer charger $\mathbf{10}_1$ transfers the toner image onto the transfer material P fed thereto by an unshown feeding device (transfer step). The transfer material P now carrying the toner image is separated by a separation discharger $\mathbf{10}_2$ from the photosensitive drum 1 (separating step). Thereafter, the transfer material P is conveyed by a conveyor belt 13 including a couple of rollers $\mathbf{14}_1$ and $\mathbf{14}_2$ to a fixing device 14, where the toner image is fixed on the transfer material P into a permanent image (fixing step). As for the image fixing system, heat fixing, pressure fixing or the like may be used.

The transfer material P after the image fixing, in this embodiment, can be moved selectively through one of three passages, in one of which it is directly discharged from the fixing device to a tray 19 by movable flappers 15 and 17 and discharging rollers 18, the movable flappers 15 and 17 taking the solid line position shown in this Figure. This passage is taken in a simplex mode wherein the image is formed on only one side of the transfer paper P.

In the second case, where a superimposing mode is selected, in which after an image is formed on one side of the transfer material P an additional image is formed on the same side. In this mode, the flapper 15 takes the broken line position, and the transfer material P is deflected by the flapper 15 in the direction indicated by an arrow a so that the transfer material P is transported through the transporting roller 20 and is received by an intermediate tray 21 with its image formed surface facing down. Then, the transfer material is fed out of the intermediate tray 21 by a feeding roller 22 to receive a second image on its same side. The transfer material P is conveyed through the transporting roller 24 to the registration roller 25 where it is once stopped.

On the other hand, the second image is formed through the above-described image forming steps on the photosensitive drum 1 as a second developed image. The transfer material P is fed to the transfer station by the registration roller 25 so as to be aligned with the second developed image at the transfer station. Then, at the transfer station, the second developed image is transferred to the transfer material P. The transfer material P is discharged to the tray after being subjected to the image fixing step. In this manner, superimposed images can be formed on one side of a transfer material.

The third case is for a duplex mode wherein images are formed on either sides of the transfer material P. In this case, the movable flappers 15 and 17 take the solid line positions, and the transfer material P carrying the first image fixed by a couple of fixing rollers $\mathbf{14}_1$ and $\mathbf{14}_2$ is conveyed to the discharging rollers 18. Between the flapper 15 and the flapper 17, there is a sensor 16 for detecting the trailing edge of the transfer material P. The discharging rollers 18 stop after a predetermined period of time passes after the sensor 16 detects the trailing edge of the transfer material P. The stopping position is so determined that the trailing edge of the transfer material P is between the flapper 17 and the discharging roller 18. Subsequently, the flapper 17 is shifted to the broken line position, and the discharging roller 18 starts rotating in the opposite direction. By this, the transfer material P is directed in the direction of an arrow b so that it is conveyed through the transportation roller 20 to the intermediate tray 21. It is placed thereon with its image formed side facing up. Subsequently, the transfer material P is fed out of the intermediate tray 21 as in the superimposing mode. It receives at the transfer station the second image on the opposite side, so that the first image and the second image are formed on the first and second sides of the transfer material P, respectively.

As described, three modes of image forming operation are possible by selecting the transportation passages.

Now, the description will be made as to the developing devices 3 and 4 in this embodiment. Each of the developing devices can be of any structure. However, for the sake is simplicity of explanation, the developing devices of this embodiment have essentially the same structure, and each includes a developing roller 3*a* or 4*a* for carrying the developer. The developing roller 3*a* or 4*a* includes, for example, a stationary magnet (not shown) and a developing sleeve (not shown) enclosing and rotatable about the stationary magnet. The developing sleeve is of non-magnetic material, for example, aluminum or stainless steel or the like. It is a possible alternative that the developing sleeve is stationary, while the magnet therein is rotatable, or that both of the magnet and the developing sleeve are rotatable.

Figure 2:
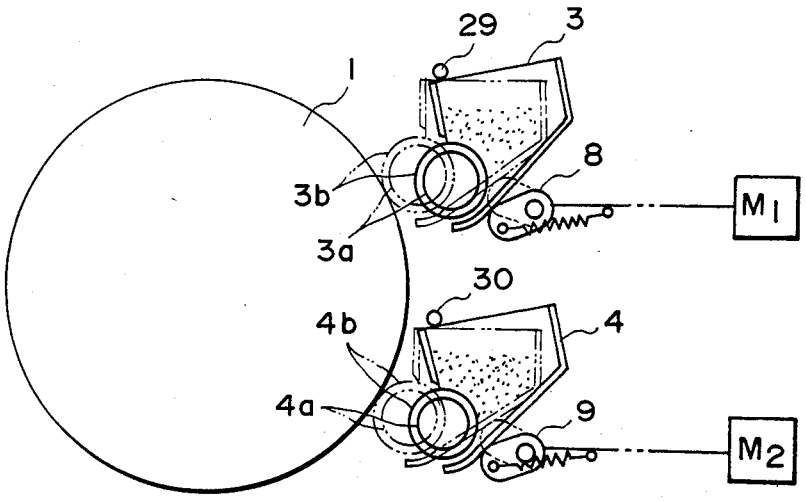
FIG. 2 is an enlarged sectional view of a part of the apparatus of FIG. 1, illustrating movement of the developing devices.

As shown in FIG. 2, the developing roller 3*a* (4*a*) is provided, at its opposite longitudinal ends, with rolls 3*b* (4*b*) having a diameter slightly larger than that of the developing sleeve. By contacting the rolls 3*b* and 4*b* to the circumference of the photosensitive drum 1 adjacent its longitudinal ends, respectively, a predetermined gap can be maintained between the photosensitive drum and the developing sleeve. In FIG. 2, only one roll is depicted, and the state wherein the rolls 3*b* and 4*b* are contacted to the photosensitive drum 1 is shown by chain lines.

In this embodiment, a red toner is contained in the developing device 3, and the black toner is contained in the developing device 4 disposed downstream of the red toner. In this embodiment, the developing devices 3 and 4 are movable by a shifting means which will be described hereinafter.

Figure 3:
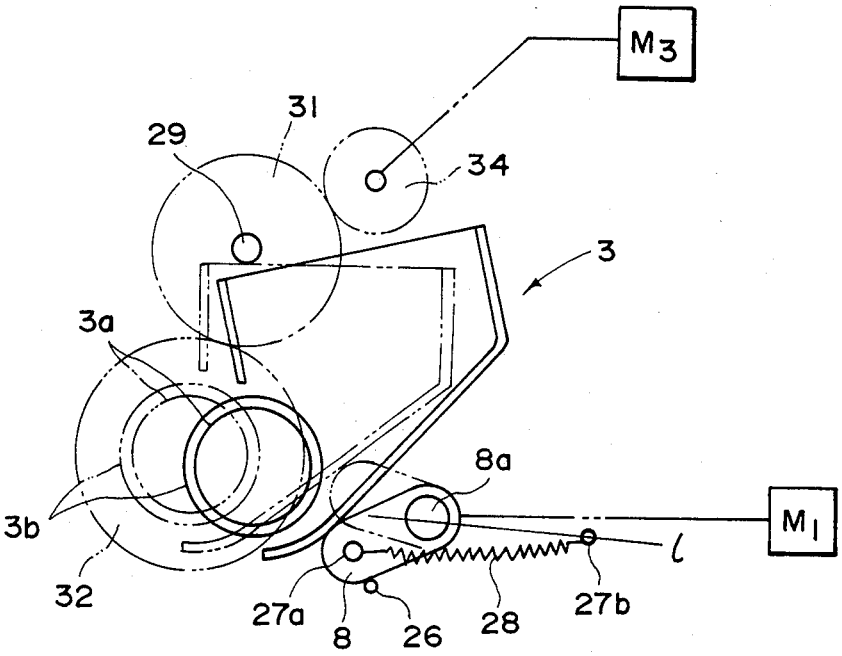
FIG. 3 is a further enlarged sectional view illustrating the movement of the developing device between the operative position and the inoperative position and illustrating rotation of the developing sleeve.

Referring to FIGS. 2 and 3, the shifting means for shifting the developing devices will be described. The shifting means comprises an eccentric cam provided for each of the developing devices. As shown in FIG. 2, the developing device 3 is shiftable between the operative position shown by chain lines wherein the developing operation may be performed and an inoperative position shown by solid lines wherein the developing operation is not performed. The developing device 3 is shiftable therebetween by rotating the eccentric cam 8 about a shaft 29. Similarly, the developing device 4 is shiftable between the operative position (chain lines) and the inoperative position (solid lines) by rotating the eccentric cam 9 about a shaft 30. In each of the operative positions, rolls 3*b* (4*b*) at opposite ends of the developing roller 3*a* (4*a*) are in contact with the photosensitive drum 1, and the developing device 3 (4) is operable to effect its developing operation. In the inoperative position, the developing device 3 (4), and therefore, the spacer rolls 3*b* (4*b*) are away from the photosensitive drum 1 so that the developing operation is not possible.

In this embodiment, the eccentric cams 8, 9 are operatively connected with respective motors M1 and M2 by way of a reduction gear. The motors M1 and M2 are reversible so as to rotate the cams to shift the developing devices 3 and 4 toward and away from the operative position. However, it is a possible alternative that a solenoid or the like is used in place of the motors, in which case the solenoid is selectively energized and deenergized so as to rotate the eccentric cam. It will be understood by one skilled in the art that another shifting means can be used for shifting the developing device.

Further description will be made as to the shifting of the developing device 3, referring to FIG. 3. When the developing device 3 is to be moved from the inoperative position to the operative position, the motor M1 rotates forwardly, whereby the eccentric cam 8 rotates about the rotational axis 8*a* from the position indicated by the solid lines in the clockwise direction (the forward rotation in this embodiment). A spring anchor 27*a* is fixed to the eccentric cam 8, while a spring anchor 27*b* is fixed on the frame of the apparatus. Between those anchors 27*a* and 27*b*, a spring 28 is stretched so that the eccentric cam 8 is urged in the direction of a line connecting the spring anchors 27*a* and 27*b*. The eccentric cam 8 continues rotating in the clockwise direction. After the line connecting the spring anchors 27*a* and 27*b* comes to extend above of a line 1 connecting the rotational axis 8*a* of the eccentric cam 8 and the spring anchor 27*b* with respect to the clockwise rotation, the motor M1 is deenergized. Thereafter, the eccentric cam 8 continues to rotate by the force of spring 28 so as to move the developing device 3, to such an extent that the rolls 3*b* coaxial with the developing roller 3*a* is brought into contact with the photosensitive drum 1 (the operative position), and the developing device 3 stops.

When the developing device 3 is to be moved from the operative position to the inoperative position, the motor M1 is rotated in the opposite direction so that the eccentric cam 8 rotates about the rotational axis 8*a* from the position indicated by chain lines in the counterclockwise direction (reversed rotation in this embodiment). After the rotation continues to such an extent that the line connecting the spring anchor 27*a* and the spring anchor 28*b* extends below the line l (ell) connecting the rotational axis 8*a* of the eccentric cam 8 and the spring anchor 27*b* with respect to the counterclockwise rotation, the motor M1 is deenergized. Subsequently, the eccentric cam 8 continues its counterclockwise rotation by the force of spring 28. When the eccentric cam 8 abuts a stopper 26 mounted to the main frame, the developing device 3 stops. This is the inoperative position of the developing device. Thus, the developing device 3 rotates about the rotational axis 29 to shift between the operative and inoperative positions.

The description will be made with respect to the rotation of the developing sleeve. There is disposed a gear 31 coaxial with the rotational axis 29. The rotation of the gear 31 is transmitted to the developing sleeve of the developing roller 3*a* through a gear 32 coaxial with the rotational axis of the developing roller 3*a*. The gear 31, on the other hand, is meshed with a gear 34 driven by a motor M3, so that the rotation of the motor M3 is transmitted to the gear 31 and the gear 32, whereby the developing sleeve of the developing roller 3*a* is driven for rotation.

The developing sleeve of the developing roller 4*a* of the other developing device 4 is driven by an unshown motor M4 through a similar mechanism.

Figure 4:
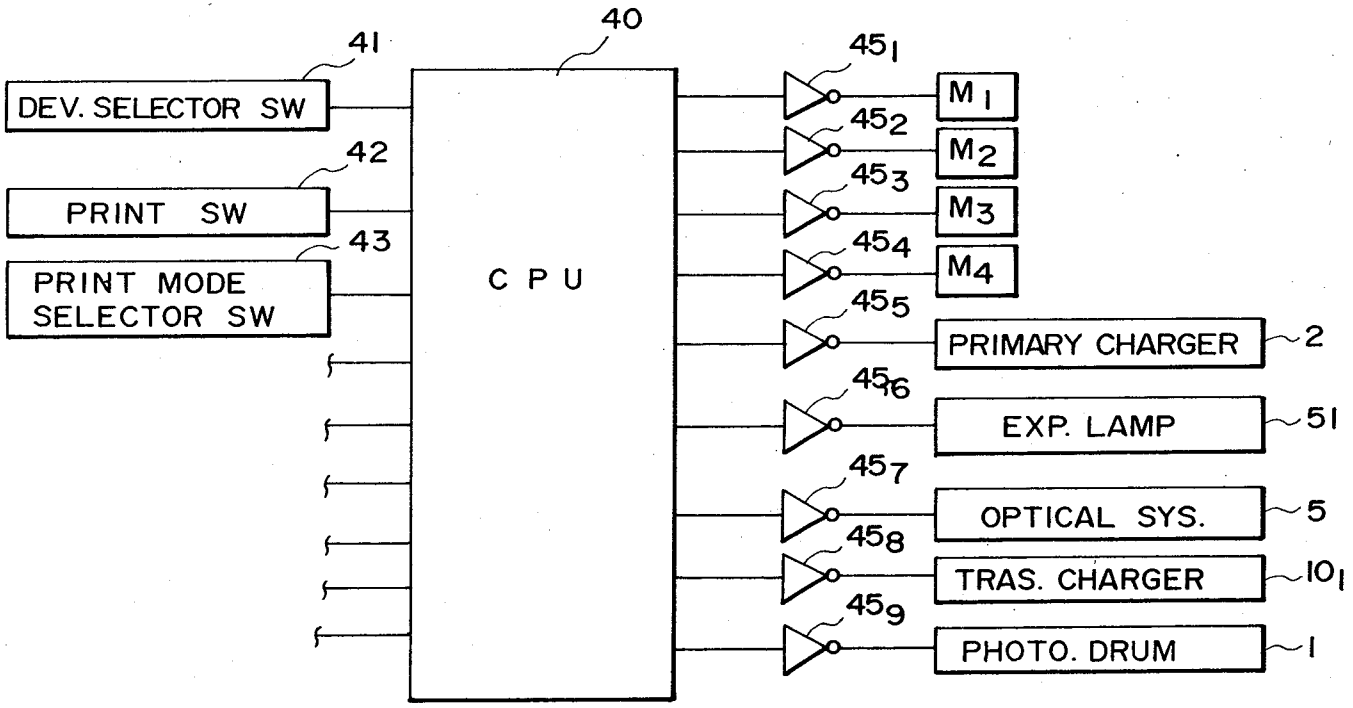
FIG. 4 is a block diagram illustrating the control circuit of the copying apparatus of FIG. 1.

FIG. 4 illustrates the control in the apparatus according to this embodiment. In this Figure, designated by a reference numeral 40 is a central processing unit (CPU), to which the signals from a developing device selection switch 41, a printing switch 42, a printing mode selection switch 43 or the like. In accordance with the command from the CPU 40, the rotations of the motors M1, M2, M3, M4, the operation of the primary charger 2, the operation of the exposure lamp 51, the operation of the optical system 5, the operation of the transfer charger 101 and the rotation of the photosensitive drum 1 or the like, are controlled through the associated drivers $\mathbf{45}_1$, $\mathbf{45}_2$, $\mathbf{45}_3$, $\mathbf{45}_4$, $\mathbf{45}_5$, $\mathbf{45}_6$, $\mathbf{45}_7$, $\mathbf{45}_8$ and $\mathbf{45}_9$.

Referring to FIG. 4 and to FIG. 5, which is a timing chart, the copying operation will be explained. As an example of operation, the developing device 4 containing the black toner is already at the operative position, and a first original and second original are developed by red toner and black toner, respectively, and the first and the second images after development are transferred onto one and the same side of a transfer material in a superimposed manner.

First, a red toner is selected by the developing device selection switch SW41, and the superimposing mode is selected in the printing mode selection switch SW43. The copy operation is started by actuating the printing switch SW42. At the point of time $T_0$ (t=0), the unshown photosensitive drum driving motor is energized, so that the photosensitive drum 1 starts rotating. At the time $T_{11}$, the CPU transmits signals to the drivers $\mathbf{45}_1$ and $\mathbf{45}_2$ to rotate the eccentric cams 8 and 9 in the forward and reversed directions, respectively to switch the developing device. Then, the motors M1 and M2 start rotating and continue to the point of time $T_{12}$. By this, the developing device 3 containing the red toner reaches the operative position at the point of time $T_{13}$, while the developing device 4 starts moving toward its inoperative position at $(T_{11}+\Delta T)$, and is positioned at the inoperative position. At the point of time $T_{14}$ which is slightly later than the point of time $T_{13}$ at which the developing device 3 reaches the operative position, a signal for rotating the developing sleeve of the developing roller 3*a* is transmitted from the CPU, so that the motor M3 starts rotating. During this period, the motor M4 for rotating the developing sleeve of the developing roller 4*a* is not rotating. The point of time $T_{13}$ may be the same as the point of time $T_{14}$. Thereafter, the image forming process is executed, wherein the primary charger 2 is actuated at the point of time $T_{15}$; the exposure lamp 51 is actuated at the point of time $T_{16}$; and the transfer charger $\mathbf{10}_1$ is actuated at the point of time $T_{17}$. When the exposure lamp 51 is actuated, the above-described optical system 5 starts the scanning action with respect to the first original, and a latent image corresponding to the first original is formed on the photosensitive drum 1. The latent image is developed with red toner contained in the developing device 3. On the other hand, the transfer material P is fed, and the red developed image is transferred onto the transfer material P by the transfer charger $\mathbf{10}_1$. After the termination of the image transfer of the developed image, the transfer charger $\mathbf{10}_1$ is deactivated at the point of time $T_{20}$ Before this, the primary charger 2, the exposure lamp 51 are deactivated at the points of time $T_{18}$ and $T_{19}$, respectively. In this embodiment, the primary charger 2 and the transfer charger $\mathbf{10}_1$ are actuated and the deactivated at different times in this embodiment. However, they may be simultaneously actuated and deactivated. More particularly, the point of time 17 may be the same as the point of time $T_{15}$, and the point of time $T_{18}$ may be the same as the point of time $T_{20}$.

After the completion of the image transfer, the transfer material P is transported to the image fixing device 14, where the image is fixed thereon. Then, the transfer material P is received on the intermediate tray 21 with its image bearing surface facing down, as described hereinbefore. On the other hand, at the point of time $T_1$, the driving motor for the photosensitive drum is deenergized, whereby the photosensitive drum 1 stops, and the motor M3 is deenergized so that the rotation of the developing sleeve of the developing roller 3*a* stops. The stoppage of the developing sleeve is not necessarily simultaneously as the stoppage of the photosensitive drum 1.

Then, a second original is placed on the original table, and the developing device selection switch SW41 is switched to the black color. Then, the print switch SW42 is actuated to restart the copying operation. The photosensitive drum driving motor is energized at the point of time $T_{00}$ so that the photosensitive drum 1 starts rotating. Subsequently, the CPU transmits signals to the drivers $\mathbf{45}_1$ and $\mathbf{45}_2$ so as to rotate the eccentric cams 8 and 9 in the backward and forward directions, respectively at the point of time $T_{21}$, for the purpose of switching the developing device. In response thereto, the motors Ml and M2 start rotating and continue until the point of time $T_{22}$. By this, the developing device 4 reaches the operative position at the point of time $T_{23}$, while the developing device 3 starts shifting toward the inoperative position at the point of time $(T_{21}+\Delta T)$, and it is stationed at the inoperative position. At a point of time $T_{24}$ which is slightly later than the point of time 23 at which the developing device 4 reaches the operative position, the CPU transmits a signal for rotating the developing sleeve of the developing roller 4*a*, so that the motor M4 starts rotating. During this, the motor M3 is not rotating. The point of time $T_{23}$ may be the same as the point of time $T_{24}$. Then, the image forming process proceeds, wherein the primary charger 2 is actuated at the point of time $T_{25}$, the exposure lamp 51 is actuated at the point of time $T_{26}$, and the transfer charger $\mathbf{10}_1$ is actuated at the point of time $T_{27}$. After the exposure lamp 51 is actuated, the optical system 5 starts scanning the second original, and a latent image corresponding to the second original is formed on the photosensitive member 1. The latent image is developed with black toner by the developing device 4. On the other hand, the transfer material P is fed from the intermediate tray 21, the black developed image is transferred onto the transfer material P by the transfer charger $\mathbf{10}_1$. Upon completion of the image transfer to the transfer material P, the transfer charger $\mathbf{10}_1$ is deactivated at the point of time $T_{30}$. Before this time, the primary charger 2 and the exposure lamp 51 are deactivated at the points of time $T_{28}$ and $T_{29}$ respectively. The point of time $T_{27}$ may be the same as the point of time $T_{25}$, and the point of time $T_{28}$ may be the same as the point of time $T_{30}$ as in the case described hereinbefore. The transfer material P now bearing the image is conveyed to the image fixing device 14, where the image is fixed, and then, the transfer material discharged out of the apparatus. At the point of time $T_2$, the photosensitive drum driving motor is deenergized so that the photosensitive drum 1 stops, and the motor M4 is deenergized so that the developing sleeve of the developing roller 4*a* stops.

In the manner described above, the red image corresponding to the first original and the black image corresponding to the second original are formed on the same side on the transfer material P as a two color superimposed image.

In this embodiment, it occurs at the point of time $T_{21}$ that the developing device 3 shifts from the operative position to the inoperative position. However, this may be effected after completion of the transfer of the first image. For example, immediately after the transfer charger $\mathbf{10}_1$ is deactivated at the point of time $T_{20}$, the developing device 3 is moved to its inoperative position, and at the point of time $T_1$, the photosensitive drum 1 is stopped. This is a possible alternative. As shown in FIG. 5 in this example, after completion of the second image formation, the developing device 4 is kept located at the operative position. However, it is a possible alternative similarly that upon completion of the second image transfer, the developing device 4 is moved from the operative position to the inoperative position. For example, it is possible that immediately after the transfer charger $\mathbf{10}_1$ is deactivated at the point of time $T_{30}$, the developing device 4 is moved to its inoperative position, and at the point of time $T_2$, the photosensitive drum 1 is stopped.

In other words, after completion of the image transfer of one image, the used developing device may be moved from the operative position to the inoperative position. The timing of this movement does not necessarily follow the deactivation of the transfer charger as described before. For example, the termination of the image transfer may be detected using unshown sensor or timer or the like, and in response to the detection, the developing device may be moved.

Figure 5:
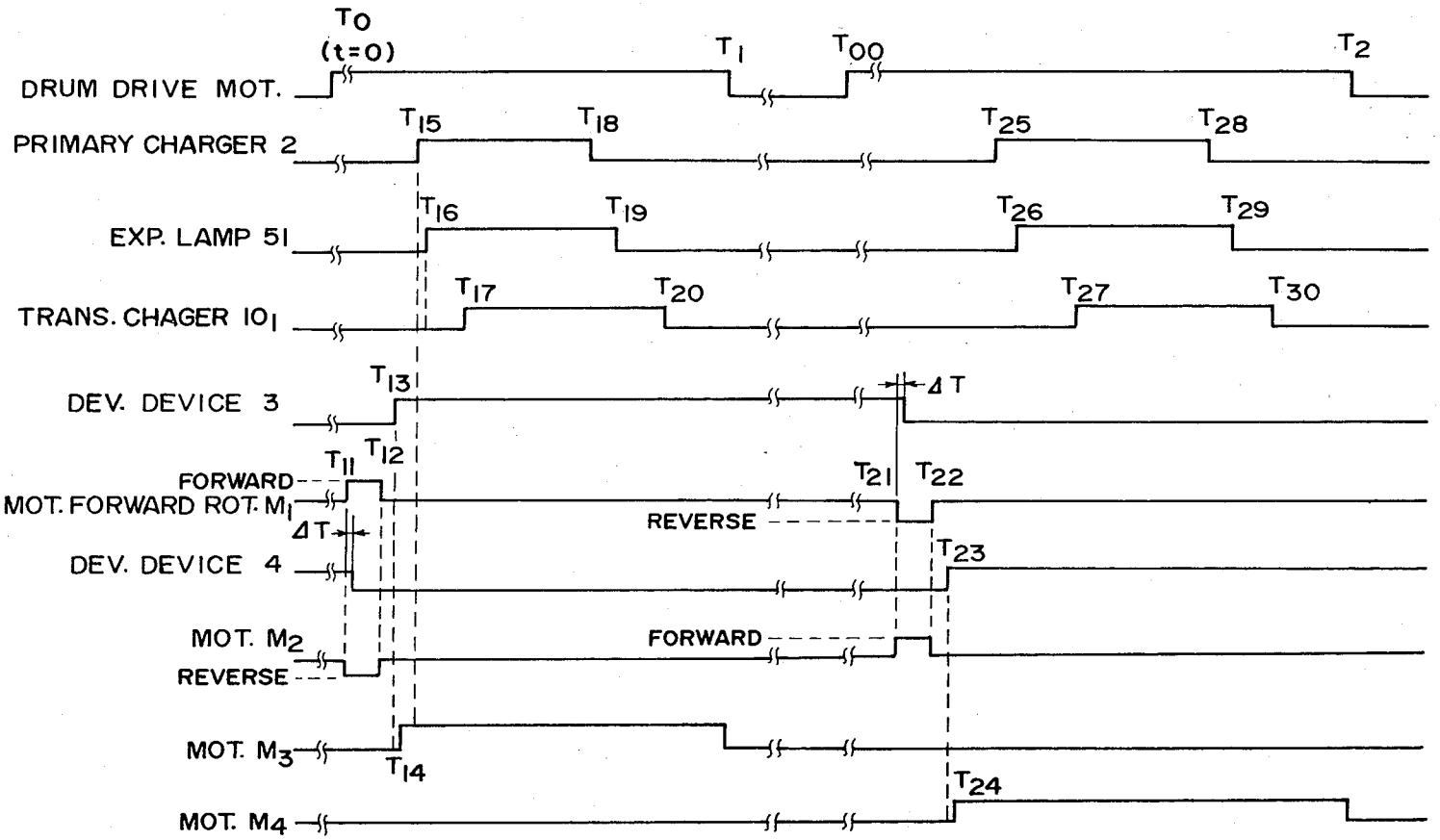
FIG. 5 is a timing chart illustrating the relations among movement of the developing device to its operative position, the movement thereof to its inoperative position, rotation of the sleeve and other image forming means.

In the case where the used developing device is kept located at the operative position until the start of the next image formation as shown in FIG. 5, the time required for the developing device to move at the start of the next image formation if the last used developing device is first used in the next image formation. This is convenient.

In this embodiment, when the developing device to be used is moved from the inoperative position to the operative position, the developing device is moved prior to the start of the charging step. However, it is a possible alternative that the developing device moves to the developing position after start of the charging step, if it is prior to the start of the exposure step. What is required is that the developing device moves to the operative position prior to the start of the exposure step.

Further, it is possible that when the image is not formed, the developing device or devices are always located at the operative position or positions, and upon the image formation, the developing device not to be used is moved to its inoperative position.

In the foregoing, the superimposed image formation mode is taken as an example of a copy operation. It will be understood, however, that the usual copying mode and duplex copying mode are possible by suitably selecting the passage of the transfer material. The points of time of actuation and deactivation in one image formation may be determined in the manner similar to that described above.

In the developing operation, a suitably predetermined developing bias is preferably applied to the developing sleeve of the selected developing device in order to obtain a desired developed image.

As will be understood from the foregoing, in the present invention, the movement of the developing device from its operative position to its inoperative position and the movement thereof from its inoperative position to the operative position, are carried out not during the image exposure step or the image transfer step. Therefore, there occurs no shock or impact to the photosensitive drum which may otherwise be produced by the movement of the developing device, during the image exposure step, so that the image is not blurred during the image exposure step. Further, the same thing applies to the period of the image transfer step, so that the problem of the misregistration of the image transfer does not take place. Accordingly, the present invention is effective to provide a good quality of the image without blur, by determining the timing of developing device movement.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

a movable image bearing member;

charging means for electrically charging said image bearing member;

means for exposing said image bearing member to light carrying information corresponding to an image to be recorded after said image bearing member is charged by said charging means, to form a latent image on said image bearing member;

at least one developing means for developing the latent image formed on said image bearing member, said developing means being movable between its operative position where it is capable of developing the latent image on said image bearing member and its inoperative position where said developing means is retracted from its operative position;

means for transferring the image developed by said developing means onto a transfer material; and control means for causing movement of the developing means between the operative position and the inoperative position to be carried out after completion of the image transfer by said transfer means;

wherein said developing means includes a developer carrying member for carrying a developer and for supplying the developer to the latent image on said image bearing member, said developer carrying member being provided adjacent its opposite ends with means contactable to said image bearing member to maintain a gap between said image bearing member and said image carrying member when the developing means is at its operative position.

2. An apparatus according to claim 1, wherein said control means causes the movement of said developing means to be carried out prior to the start of operation of said charging means.

3. An apparatus according to claim 2, wherein said control means causes the movement of said developing means to be carried out after the start of movement of said image bearing member.

4. An apparatus according to any one of claim 1 to 3, wherein said developing means includes a plurality of developing devices which contain different color developers, and wherein said control means causes a selected developing device of the plural developing devices to move between its operative position and its inoperative position.

5. An image forming apparatus, comprising:

a movable image bearing member;

charging means for electrically charging said image bearing member;

means for exposing said image bearing member to light carrying information corresponding to an image to be recorded after said image bearing member is charged by said charging means, to form a latent image on said image bearing member;

at least one developing means for developing the latent image formed on said image bearing member, said developing means being movable between its operative position where it is capable of developing the latent image on said image bearing member and its inoperative position where said developing means is retracted from its operative position; and means for transferring the image developed by said developing means into a transfer material; and control means for causing movement of said developing means between the operative position and the inoperative position to be carried out after completion of the image transfer by said transfer means.

6. An apparatus according to claim 5, wherein said control means causes the movement of said developing means to be carried out after termination of operation of said transfer means.

7. An apparatus according to claim 6, wherein said control means causes the movement of said developing means to be carried out prior to stoppage of the movement of said image bearing member.

8. An apparatus according to claim 7 wherein said control means causes said developing means to be disposed at its operative position prior to the start of the image exposure by said image exposure means, and to be disposed at its inoperative position after completion of image transfer by said image transfer means.

9. An apparatus according to claim any one of claims 5 to 8, wherein said developing means includes a plurality of developing devices, wherein the plural developing devices contain different color developers, and wherein said control means causes a selected developing device of the plural developing devices to be moved between its operative position and its inoperative position.

10. An image forming apparatus, comprising:

a movable image bearing member;

charging means for electrically charging said image bearing member;

means for exposing said image bearing member to light carrying information corresponding to an image to be recorded after said image bearing member is charged by said charging means, to form a latent image on said image bearing member;

first developing means for developing the latent image formed on said image bearing member, said developing means being movable between its operative position where it is capable of developing the latent image on said image bearing member and its inoperative position where said developing means is retracted from its operative position;

second developing means, disposed above said first developing means, for developing the latent image formed on said image bearing member, said second developing means being movable between its operative position where it is capable of developing the latent image on said image bearing member and its inoperative position where said second developing means is retracted form its operative position;

means for transferring the image developed by said first and second developing means onto a transfer material, and control means for causing movement of said first and second developing means between the operative position and inoperative position to be carried out after completion of the image transfer by said transfer means;

wherein said first and second developing means each includes a developer carrying member for carrying a developer and for supplying the developer to the latent image on said image bearing member, said developer carrying member being provided adjacent its opposite ends with means contactable to said image bearing member to maintain a gap between said image bearing member and said image carrying member when the developing means is at its operative position, and wherein when one of said developing means is at its operative position and the other developing means is at its inoperative position, said one developing means and said other developing means are simultaneously moved to the inoperative position and to the operative position, respectively, from an image formation start signal to image exposure of said image bearing member, in response to a switching signal.

* * * * *

UNITED STATES PATENT AND TRADEMARK OFFICE

CERTIFICATE OF CORRECTION

PATENT NO. : 4,801,966

DATED : January 31, 1989

INVENTOR(S) : MASAMICHI IKEDA

It is certified that error appears in the above-identified patent and that said Letters Patent is hereby corrected as shown below: Title page:

IN [57] ABSTRACT

Line 14, "not during the" should be deleted.

SHEET 3 OF 4

FIG. 4, "TRAS. CHARGER" should read --TRANS. CHARGER--.

SHEET 4 OR 4

FIG. 5, "TRANS. CHAGER" should read --TRANS. CHARGER--.

COLUMN 2

Line 22, "sup-" should be deleted.
Line 23, "porting member." should be deleted.

COLUMN 5

Line 47, "is" should read --of--.

COLUMN 6

Line 56, "of" should be deleted.

COLUMN 7

Line 40, "ger 101" should read --ger 10,--.

COLUMN 8

Line 23, "time $T_{20}$" should read --time $T_{20}$.--.
Line 30, "time 17" should read --time $T_{17}$--.
Line 63, "time 23" should read --time $T_{23}$--.

UNITED STATES PATENT AND TRADEMARK OFFICE

CERTIFICATE OF CORRECTION

PATENT NO. : 4,801,966

DATED : January 31, 1989

INVENTOR(S) : MASAMICHI IKEDA

It is certified that error appears in the above-identified patent and that said Letters Patent is hereby corrected as shown below:

COLUMN 11

Line 14, "said image carrying member" should read --said developer carrying member--.
Line 24, "claim 1 to 3," should read --claims 1 to 3,--.
Line 49, "into" should read --onto--.
Line 62, "claim 7" should read --claim 5,--.

COLUMN 12

Line 4, "claim" should be deleted.
Line 35, "form" should read --from--.
Line 38, "material," should read --material;--.
Line 52, "and said image" should read --and said developer--.

Signed and Sealed this

Seventh Day of August, 1990

*Attest:*

*Attesting Officer*

HARRY F. MANBECK, JR.

*Commissioner of Patents and Trademarks*